US005211595A

United States Patent [19]

Kowalczyk et al.

[11] Patent Number: 5,211,595

[45] Date of Patent: May 18, 1993

[54] METHOD OF MANUFACTURING AN ARC TUBE WITH OFFSET PRESS SEALS

[75] Inventors: Lou Kowalczyk, Alfred Station; Bart van der Leeuw, Hammondsport, both of N.Y.

[73] Assignee: North American Philips Corporation, New York, N.Y.

[21] Appl. No.: 916,573

[22] Filed: Jul. 20, 1992

[51] Int. Cl.[5] ..... H01J 9/32

[52] U.S. Cl. ..... 445/26; 313/634; 65/59.26

[58] Field of Search ..... 445/26; 65/59.26; 313/634

[56] References Cited

U.S. PATENT DOCUMENTS

| | | | |
|---|---|---|---|
| 2,857,712 | 10/1958 | Yoder et al. | 65/155 |
| 2,965,698 | 12/1960 | Gottschalk | 313/318 |
| 3,939,538 | 2/1976 | Hellman et al. | 445/1 |
| 4,001,623 | 1/1977 | Howles et al. | 313/184 |
| 4,056,751 | 11/1977 | Gungle et al. | 313/217 |
| 4,232,234 | 11/1980 | Rigden | 313/634 X |
| 4,232,243 | 11/1980 | Rigden | 313/217 |
| 4,850,499 | 7/1989 | White et al. | 220/2.1 R |
| 4,959,587 | 9/1990 | Schug | 313/623 |
| 5,016,150 | 5/1991 | Gordin et al. | 362/263 |
| 5,051,655 | 9/1991 | Wiley | 313/631 |
| 5,055,740 | 10/1991 | Sules | 313/634 |

*Primary Examiner*—Kenneth J. Ramsey
*Attorney, Agent, or Firm*—Brian J. Wieghaus

[57] ABSTRACT

A method of producing a high pressure discharge lamp arc tube having discharge electrodes extending from respective press seals into opposing end chambers of continuously reducing cross-section. The press seals are positioned offset from the axis of the arc tube in a direction normal to their plane by positioning the lead-through and discharge electrode within the end portion of a length of tube of vitreous material offset from the tube axis by a predetermined distance, heating the end portion of the tube to its softening temperature, and moving opposing press jaws against said end portion in such a manner that the press seal is formed about said lead-through offset in a direction normal to the plane of the press seal and away from the tip-off. The press jaws may include mold portions for accurately forming the end chambers. During pressing, the tube is pressurized with a gas to blow mold the end chambers in the mold portions.

20 Claims, 5 Drawing Sheets

METHOD OF MANUFACTURING AN ARC TUBE WITH OFFSET PRESS SEALS

CROSS REFERENCE TO RELATED APPLICATIONS

This application relates to copending U.S. application Ser. No. 07/916,559, filed concurrently herewith, entitled "HID LAMP HAVING AN ARC TUBE WITH OFFSET PRESS SEALS", of Louis N. Kowalczyk and Bart van der Leeuw which discloses and claims an HID lamp with an arc tube having a generally cylindrical body defining a cylinder axis, end chambers of continuously reducing cross-section, and press seals offset from the cylinder axis in a direction normal to the press seals.

BACKGROUND OF THE INVENTION

The invention relates to a method of manufacturing a high pressure discharge lamp arc tube having press seals at each end thereof and opposing end chambers into which respective discharge electrodes extend, the method including the steps of providing a length of tubing of vitreous material having a longitudinal tube axis, providing a conductive lead-through connected to a discharge electrode, positioning said lead-through and electrode with respect to an end portion of the tube, softening the end portion by heating, and pressing the end portion with opposing press jaws to form a generally planar press seal about said lead-through.

Such a method is known for making high pressure mercury vapor lamps from U.S. Pat. Nos. 2,965,698 (Gottschalk) and U.S. Pat. No. 2,857,712 (Yoder et al) (herein incorporated by reference). The vitreous tubing is a cylindrical tube of quartz glass (fused silica) and is supported in a press sealing machine. The lead-through connected to the discharge electrode is positioned within a respective end portion of the tube by holding it in a suitable chuck, or holder. During heating of the end portions and sealing, a flow of an inert gas such as nitrogen is provided over the lead-throughs to prevent oxidation. The lead-through and discharge electrode are positioned within the end portions of the quartz glass tube prior to heating of the tube end portion, but may also be positioned therein during or after heating with burners.

U.S. Pat. No. 3,939,538 (Hellman et al) discloses a method of making a metal halide lamp in which the press jaws further include a mold portion for forming the end chambers. A back pressure of nitrogen is supplied through a conventional tubulation in the quartz glass tube to outwardly blow the softened glass and mold it against the press jaws to control the shape of the end chambers. When forming the press seal at the first end of the arc tube, a suitable stopper is used to plug the still open end.

In the above methods a discharge sustaining filling comprised of mercury and a rare gas is added to the arc tube through the tubulation after forming press seals at both ends of the lamp. Metal halide lamps further include one or more metal halides to improve the color rendering and color of the lamp.

When a mercury vapor or metal halide arc tube is operated horizontally, the arc arches or bows upward due to convection currents within the discharge space. This tends to overheat the upper wall of the arc tube, which leads to a shortened lamp life. The bowed arc also causes an uneven temperature profile between the upper and lower walls of the arc tube, leading to increased condensation of the lamp fill material as compared to a similar vertically operated lamp. This adversely effects photometric parameters such as correlated color temperature (CCT), color rendering (CRI), and luminous efficacy. Thus, arc tubes intended for horizontal operation typically include design features to alleviate these problems.

For example, U.S. Pat. No. 4,001,623 (Howles et al) discloses a mercury vapor/metal halide lamp having a cylindrical body with vertically oriented press seals and asymmetric end chambers in which the discharge electrodes extend axially but are offset from the cylinder axis towards the lower wall in the plane of the press seal. This lowers the arc away from the upper wall to provide a more uniform temperature distribution. In a further embodiment, the upper wall is given the shape of a catenary during press seal formation to further improve the temperature profile. U.S. Pat. No. 5,055,740 (Sulcs) discloses a similar arc tube in which the greatest length of the arc tube is at the elevation of the electrodes. U.S. Pat. No. 4,056,751 (Gungle et al) discloses an alternative design in which the arc tube is arched to match the shape of the discharge arc during lamp operation. Gungle's arched shape, however, requires extra glass forming steps to bend the arc tube body, and increases the effective diameter of the arc tube, making it unsuitable for lamps intended for small fixtures.

A disadvantage of all of the above designs is that the press seals are vertically-oriented during horizontal operation of the arc tubes. It is known from U.S. Pat. No. 4,850,500 (White et al) that end chambers typically include irregularities such as corners and crevices, inadvertently formed during pressing, where they meet the press seals of the arc tube. Thus, rather than the smoothly shaped end chamber walls shown in the Howles and Sulcs patents, in practice these lamps have been found to have crevices "C" at the juncture of the press seals and the end chamber, as shown in FIG. 1. When operated horizontally, the cold spot on the arc tube is generally on the lower wall, and typically behind the electrodes. With vertically oriented press seals, it has been found that the fill constituents tend to condense and pool in the crevices, reducing the partial pressures of the constituents. The corners and crevices are the source of a larger than desired spread in photometric parameters among a given number of lamps due to the variation in the corners and crevices produced during pressing.

In White et al, the corners are reduced or eliminated by an additional, secondary pressing operation normal to the major press which forms notches, or "dimples", at the juncture of the arc tube body and press seal. However, the secondary pressing operation is an additional manufacturing step, requiring additional press jaws and modified pressing equipment, which adds to lamp cost. Furthermore, Whites' arc tube has a straight cylindrical body with centered axially extending discharge electrodes. Thus, in addition to requiring an additional pressing operation, this construction would suffer from the asymmetric temperature profile of the arc tube wall due to the arched discharge arc as discussed above.

U.S. Pat. No. 5,016,510 (Gordin et al) discloses an embodiment of an HID lamp in which the press seals are horizontally oriented and the electrodes are aligned on the cylinder axis. The lower wall of the arc tube is locally flattened to move it closer to the discharge arc (FIGS. 2A and 2B), which requires the extra steps of heating the arc tube along its lower wall and then pressing it flat. In FIG. 2A, the dashed line represents the lower wall of the arc tube prior to flattening. While reducing the temperature difference between the flattened portion of the lower wall and the upper wall, the problem of overheating of the upper wall is not addressed. Additionally, flattening of the lower wall introduces longitudinal zones "A" having a locally irregular curvature. As shown in FIG. 2*b*, the radius $R_A$ of these zones is larger than the nominal radius R of the unflattened portions of the arc tube. The arc tube wall in these zones is further from the discharge arc than the flattened portion and may be the undesired location for condensation and pooling of the fill constituents. Furthermore, the extra step of heating and flattening the bottom of the arc tube increases production costs.

SUMMARY OF THE INVENTION

Accordingly, it is the object of the invention to provide a method for manufacturing a high pressure discharge lamp with an arc tube of improved shape that overcomes the above-mentioned performance and manufacturing disadvantages.

The above objects are accomplished in a method of the type described in the opening paragraph by:

positioning the press seal, lead-through, and discharge electrode offset from the longitudinal axis of the tube in a direction normal to the press seal.

Arc tubes made by this method are operated in a horizontal position with the press seals at both ends of the arc tube horizontal and below the axis of the arc tube. As used herein, the terms "upper" and "lower" refer to the portions or walls of the arc tube which are above and below, respectively, the press seals when the arc tube is in a generally horizontal operating position with the press seals horizontal.

The above method is advantageous because it forms an arc tube with offset electrodes in which the lower wall of the end chamber, towards which the electrodes and press seal are offset, is smoothly curving and free of crevices. Any crevices formed during pressing are in the press seal plane at the juncture of the press seal and end chamber and are situated above the lower wall of the end chamber (on which the fill constituents pool). Lamps operated with arc tubes in this position and formed by this method have been found to have better uniformity of photometric parameters as compared to prior art lamps in which the press seals are vertically oriented during operation.

According to a favorable embodiment of the method, the press seal is initially formed offset from the longitudinal tube axis by positioning the lead-through and the electrode within the tube end portion offset from the tube axis, and by positioning and moving the opposing press jaws to press the heat-softened end portion of the tube about the lead-through while holding the lead-through and tube fixed relative to each other, maintaining the offset position of the lead-through and electrode. Since the electrode and press seal are offset during the pressing operation, no additional manufacturing steps are required over prior art lamps in which the press seals are formed on the tube axis.

In another aspect of the method, the press jaws are provided with respective opposing mold portions, and a gas pressure is applied within said tube for blowing the softened end portion against the mold portions for forming the end chamber. This step provides an accurate end chamber shape with surprising uniformity in thickness between the upper and lower end chamber walls, despite the offset of the press seal from the longitudinal axis of the tube.

According to another embodiment, the lead-through and discharge electrode are positioned within the end portion of the tube such that they are aligned with a plane through the tube axis and normal to the press jaw faces in the closed position of the press jaws.

In still another embodiment, the method further comprises angling the discharge electrode with respect to the lead-through, and positioning the lead-through in the tube end portion laterally offset from the tube axis. A starting electrode connected to another lead-through is positioned laterally offset on the opposite side of the tube axis. Upon closing of the press jaws the discharge electrode is coplanar with the press seal and the tip of the electrode is aligned with a plane through the tube axis which extends normal to the press seal. This step is advantageous because it provides ample spacing between the lead-throughs of the starting and discharge electrode and between both lead-throughs and the side edges of the press seal so that seal reliability is maintained.

According to a favorable embodiment of the method, the tube provided is a right circular cylinder. This is advantageous because fused silica tubing of circular cross section is used for arc tubes for vertical operation, obviating the need to stock or produce different tube shapes. Circular tubing is also the cheapest and easiest to handle. Furthermore, extra glass forming steps are not required as in some prior art lamps. Thus, lamp manufacturing costs are minimized while achieving greater uniformity in performance among manufactured lamps.

These and other aspects and advantages of the method according to the invention will become apparent from the drawings and detailed description which follow.

DESCRIPTION OF THE PREFERRED EMBODIMENT

Figure 3:
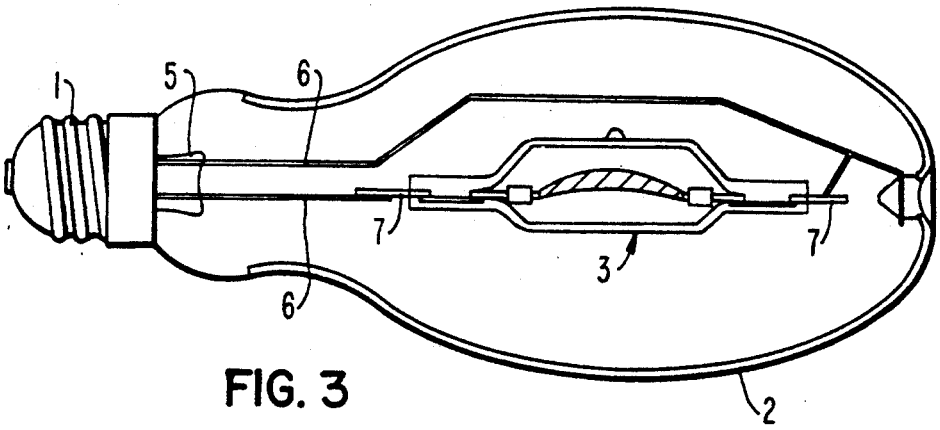
FIG. 3 illustrates an HID metal halide lamp according to the invention having an arc tube with offset press seals mounted within an outer envelope.

FIG. 3 shows an HID metal halide lamp having a lamp base 1 connected to an outer envelope 2 in which an arc tube 3 is disposed. Current supply conductors 6, connected to respective contacts on the lamp base 1, extend from the lamp stem 5 into the outer envelope and are electrically connected to respective conductive lead-throughs 7 of the arc tube 3 for supplying electric current thereto and supporting the arc tube within the outer envelope.

Figure 4A:
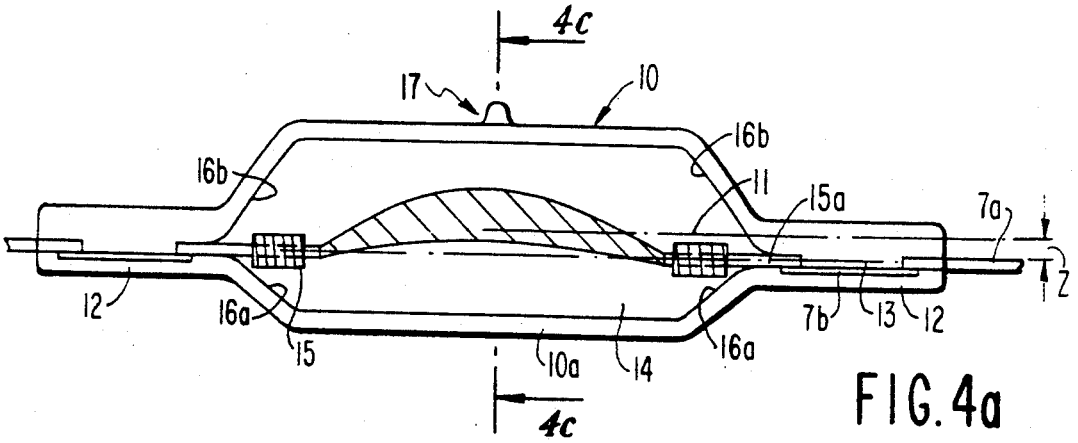
FIG. 4A is side view of an arc tube according to the invention.
Figure 4B:
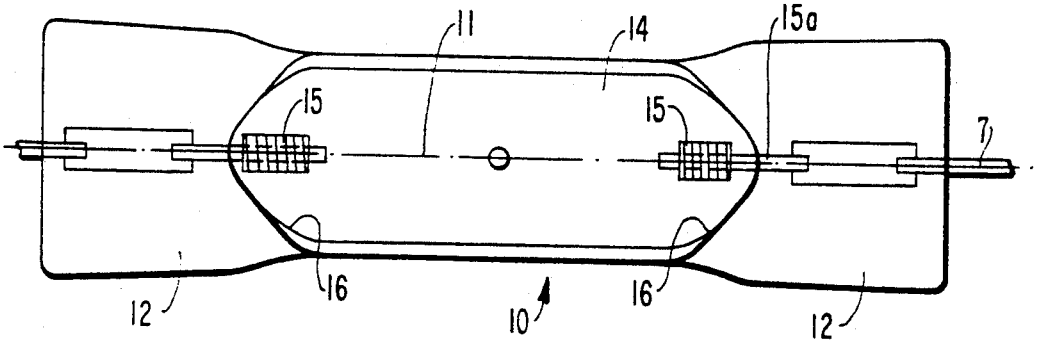
FIG. 4B is a top view of the arc tube of FIG. 4A.

FIGS. 4A, 4B show the arc tube 3 in more detail. The arc tube has a cylindrical body 10 which defines a cylinder axis 11 and is sealed at each end by respective press seals 12 to enclose a discharge space 14. The discharge space contains a conventional filling comprised of mercury, sodium, and one or more metal halides such as scandium iodide, and a rare gas, such as argon. The foliated lead-throughs 7 are conventional and include an outer conductive lead 7*a* welded to a molybdenum foil 7*b*. Conventional wire-wound discharge electrodes 15 are disposed in end chambers 16 of continuously reducing cross-section adjacent the press seals 12. The electrode rods 15*a* are welded to the foils 7*b* in a conventional manner.

According to the invention, the press seals 12 are offset from the cylinder axis 11 towards the lower wall 10*a* of the arc tube by a predetermined distance 'z' in a direction normal to the plane of the press seals and away from the tipped off tubulation 17. The lower circumferential wall portion 10*a* of the cylindrical body, towards which the press seals are offset, is smoothly curving and free of flats in cross-sections normal to the cylinder axis. The lower wall portions 16*a* of the end chambers, which extend between the respective press seal 12 and the lower circumferential wall portion 10*a*, are smoothly curving and are free of crevices or other irregularities in which the fill constituents could pool.

Figure 4C:
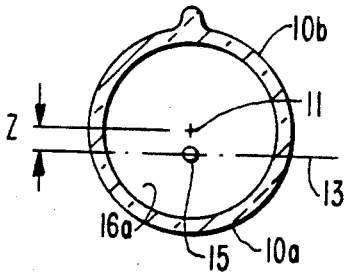
FIG. 4C is a cross-section of the arc tube of FIG. a taken on the line 4C—4C.

In the embodiment shown in FIGS. 4A—4C, the cylindrical body 10 is a right circular cylinder and the press seals 12 lie in a common plane 13. The discharge electrodes 15 are aligned in said common plane 13 with one another and with a central plane normal to said press seals through the cylinder axis 11. The end chambers 16 are asymmetric about the press seal plane 13 (FIG. 4A). The arc tube is symmetric about the central plane, as illustrated in FIG. 4B. In contrast, the Howles and Sulcs arc tubes are symmetric about the press plane. The specific shape of the end chambers is discussed below in the description of the pressing method.

During lamp operation in its horizontal position shown in FIGS. 3 and 4A, the discharge arc arches upwards due to convection currents in the arc tube. Because the press seals and the discharge electrodes are displaced closer to the lower circumferential wall portion 10*a* and further away from the upper wall portion 10*b*, overheating of the upper wall 10*b* is avoided and a more uniform temperature profile is achieved than if the discharge electrodes were centered on the axis 11. During horizontal lamp operation, the cold spot of the arc tube, which is where the metal halide salts condense and which controls the partial pressures of the metal halides, is located on the lower wall 10*a*. Because the end chamber portions 16*a* and the lower wall portion 10*a* are smoothly curving and free of crevices, the surface area of the arc tube over which the metal halides condense and pool is increased. This is favorable for lamp photometric parameters because for a given cold spot temperature the metal halides will be more readily evaporated due to the larger surface area of the salts and have a greater partial pressure as compared to lamps according to the prior art in which the metal halide salts condensed and pooled in crevices in the vertical press seals. Additionally, lamps according to the invention were found to have a smaller lamp-to-lamp variations in photometric parameters because of the absence of crevices in areas where the fill constituents condense. Any crevices which form as the result of the press sealing process lie in the common plane 13 of the press seals, well above the locations at which the lamp fill constituents condense and pool.

Figure 5:
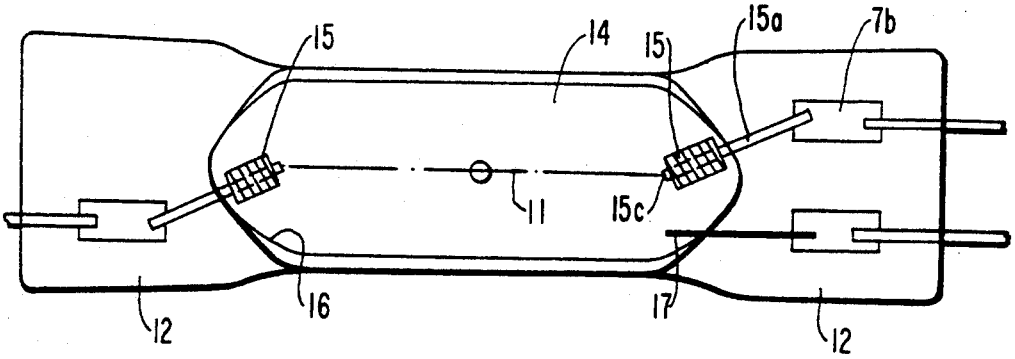
FIG. 5 is a top view of an arc tube according to another embodiment of the invention.

FIG. 5 shows a lamp according to another embodiment of the invention which includes a starting electrode 17 at one end of the arc tube. The lead-throughs 7 of the starting electrode 17 and discharge electrode 15 are positioned in the press seal laterally offset on opposite sides of the axis 11. The electrode rod 15*a* of the discharge electrode is welded to the foil 7*b* at an angle such that its tip 15*c* is laterally positioned on the axis 11 in said common plane 13. The starting electrode is conventionally positioned adjacent the discharge electrode to facilitate lamp starting and may be angled towards the cylinder axis or extend axially. The discharge electrode at the other end of the arc tube without the starting electrode may likewise be offset and angled or it may extend axially on the centerline.

Metal halide lamps with starting electrodes are typically those with a rated power of 150W or greater. Lamps of smaller wattage can typically be started without starting electrodes using a high voltage pulse instead. For manufacturing considerations, lamps without starting electrodes may similarly have one or both discharge electrodes angled in the plane of the press as shown in FIG. 5 to facilitate common tooling.

METHOD OF MANUFACTURE

In the method according to the invention, the press seals are positioned offset from the longitudinal axis of the tube a predetermined distance in a direction normal to the plane of the press seals.

Figure 6A:
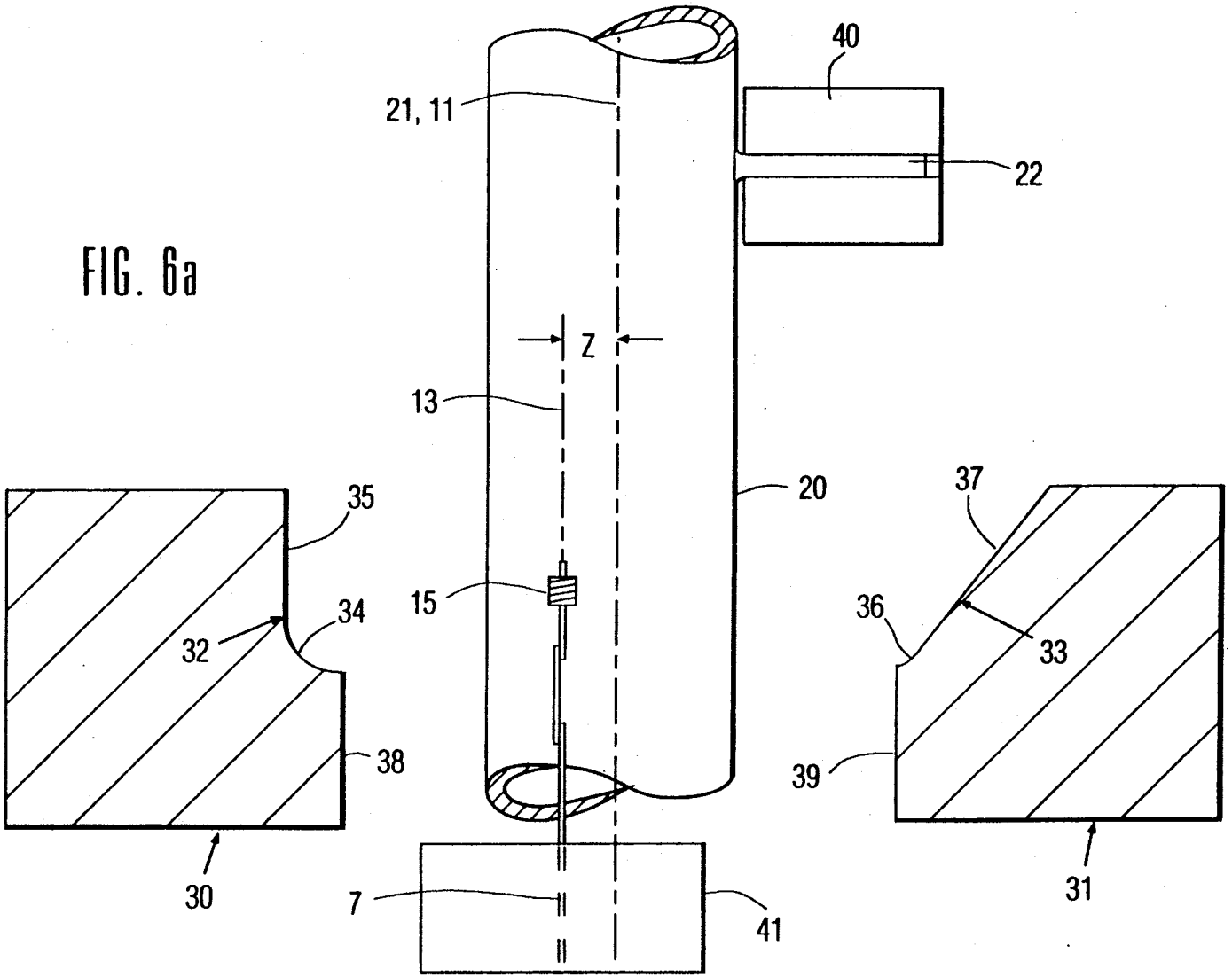
FIGS. 6A and 6B illustrate the arrangement of the fused silica tube, press jaws, and lead-through according to the preferred method of producing the arc tube.
Figure 6B:
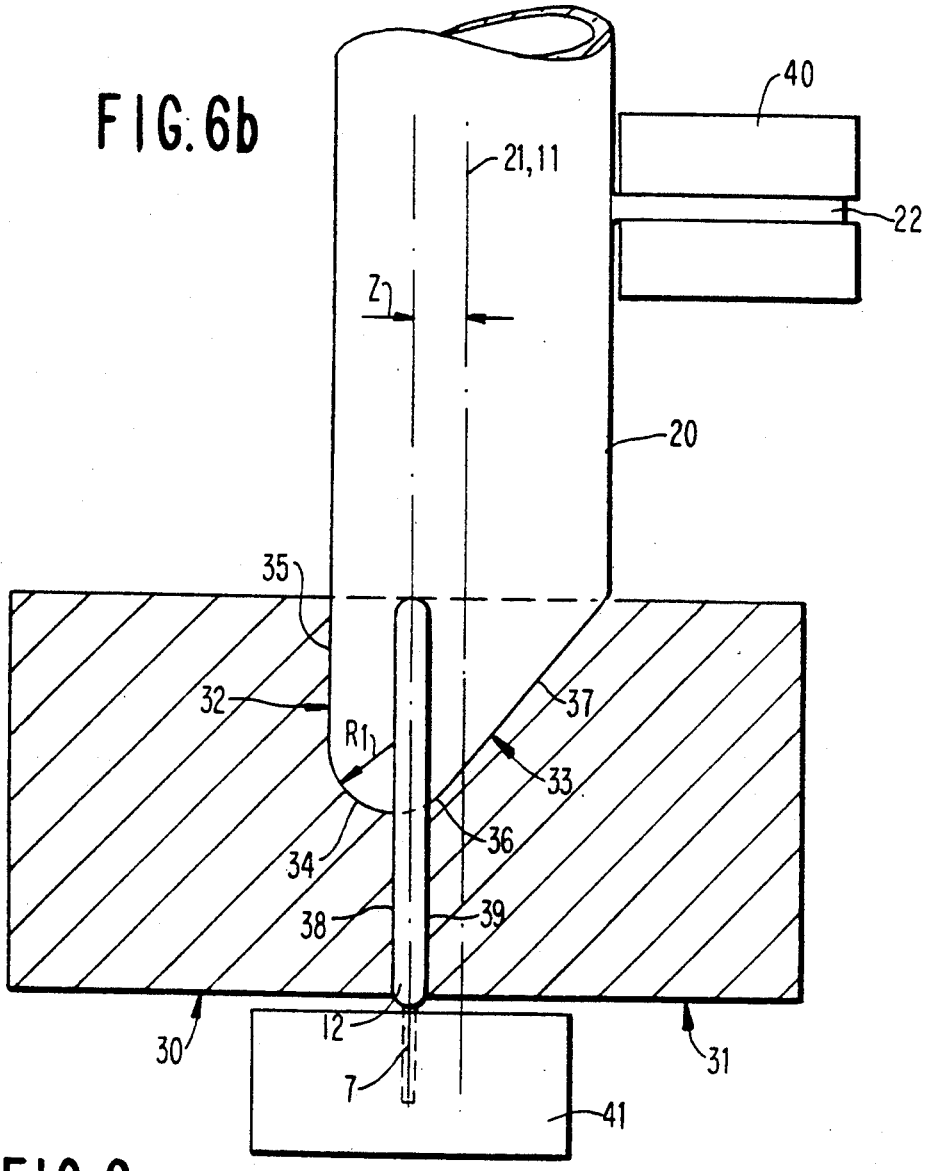

Favorably, this is accomplished by initially forming the press seals offset from the longitudinal axis of the tube according to the following steps. As shown in FIG. 6A, a circular cylindrical length of fused silica tube 20 already provided with a tubulation 22 is held by this tubulation in a tubulation holder 40. The discharge electrode, and the starting electrode if included, are held in a chuck 41 and positioned longitudinally with respect to the quartz glass tube and radially offset from the longitudinal tube axis 21 (corresponding to the arc tube cylinder axis 11) a predetermined distance "z". The opposing press jaws 30, 31 include mold portions 32, 33 for forming the end chambers. The jaws are arranged and moved so that in their closed position their opposing press faces 38, 39, which form the planar portion of the press seal, are equidistant from the lead-through 7. After heating the end portion of the tube to its softening temperature in a conventional manner (not shown), the press jaws are quickly pressed together, forming a press seal 12 about the lead-through offset from the tube axis 21 and coplanar with the discharge electrode. (FIG. 6B) A back pressure of nitrogen is provided through the tubulation 22 to blow the softened glass outwardly against the mold portions 32, 33 in the closed position of the jaws to precisely form the end chambers.

A press seal is then formed at the other end of the tube offset the same distance "z" from the tube axis such that it is coplanar and symmetric with the press seal formed at the first end. The arc tube is then conventionally dosed through the tubulation, which is then tipped off.

For arc tubes without starting electrodes, the lead-through and electrode may be held in chuck 41 aligned with a plane through the axis 21 and normal to the press seal. Where the arc tube includes a starting electrode, the electrode rod is preferably welded at an angle with respect to the foil 7*b*, as shown in FIG. 5. The lead-throughs of the starting and discharge electrodes are then held in chuck 41 so that they are laterally offset from this plane, for the reasons previously discussed.

Figure 6C:
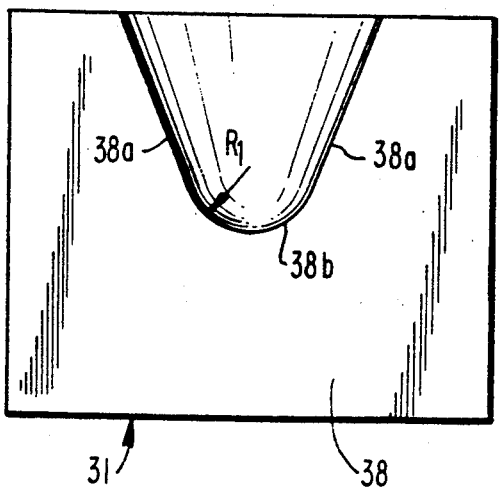
FIG. 6C is a front view of one of the press jaws.

The opposing press jaws are asymmetric with respect to each other (FIG. 6B) in cross-sections normal to the plane of the press seal. The mold portion 32 of the bottom press jaw 30 includes a first arc 34 with a radius R1 merging into a bottom surface 35 parallel to the press plane. The mold portion of the top press jaw 31 includes a second arc 35 with the same radius R1 and a top surface 37 angled with respect to the press plane. The press faces 38, 39 are substantially flat for forming a generally planar press seal and may include reliefs for forming detents for frame support straps, etc. As shown in FIG. 6C, the mold portion 32 of the press jaw 30 includes angled side edges 38*a* which merge into a rounded edge 38*b* at the face 38. The rounded edge 38*b* has the same radius R1. The press jaw 31 includes identical edges at its face 39. The jaws may be readily fabricated according to well known machining techniques.

The wall thickness of the end chambers was found to be uniform despite the offset of the press seal from the tube axis. Thinning of the upper wall 16*a* with respect to the lower wall 16*b*, which might be expected due to the different distances over which the opposing sides of the softened end portions are displaced by the press jaws, substantially did not occur. This is believed to be due to the blow molding of the softened end portion into the mold chambers along with an inherent gathering action of the softened quartz glass. Accordingly, the walls of the end chambers are defined by the shape of the press jaw mold portions 32, 33.

The offset 'z' of the press seal plane and the discharge electrode from the tube axis will vary with arc tube size, but will generally be less than about 50% of the inside radius. Too large of an offset will position the electrode too close to the lower wall and cause overheating while too small of an offset will reduce the cold spot temperature below optimum and reduce the salt content in the arc stream. The ratio of the offset "z" to the inside radius will generally be larger as the arc tube wattage and inside radius increase.

Additionally, while the cavity shape of the mold portions, (and the corresponding end chamber shape) are typically free of flats, it is feasible that for larger wattage arc tubes, for example 1000 watts, the mold cavities and end chambers may include flats. For example, the lower end chamber 16*a* and corresponding mold portion 30 may include curved side portions extending from the press plane which smoothly merge into a flat bottom portion joining the two curved side portions. Such a shape may facilitate the machining of the mold cavities to ensure smooth merging of the upper and lower end chamber walls at the press seal.

EXAMPLE

Figure 1:
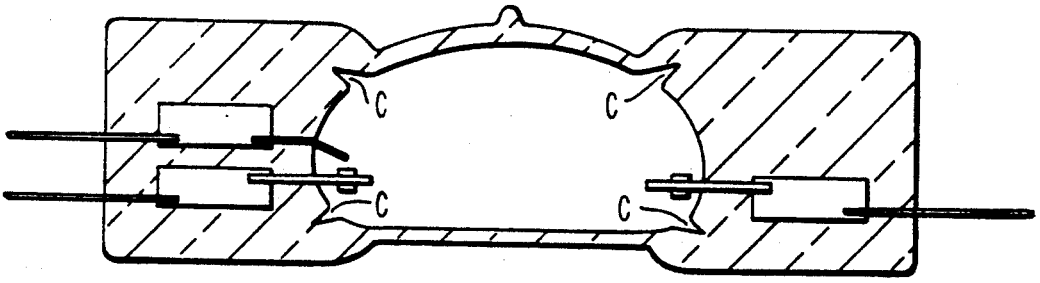
FIG. 1 PRIOR ART
FIG. 1 illustrates an arc tube according to the prior art having vertically oriented press seals and showing the presence of crevices in the end chambers.
Figure 2A:
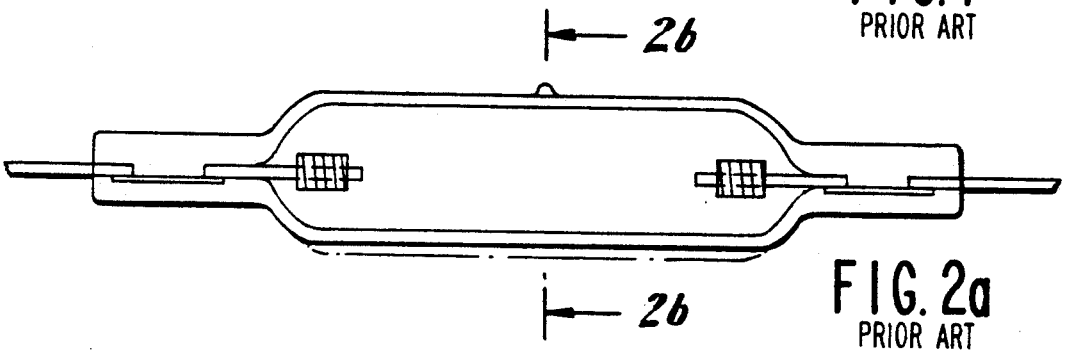
FIG. 2a PRIOR ART
FIG. 2A illustrates another arc tube according to the prior art have a flattened portion on its lower wall.
Figure 2B:
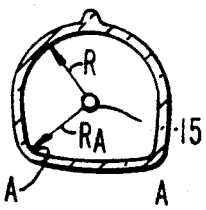
FIG. 2b PRIOR ART
FIG. 2B shows a cross-section of the arc tube of FIG. 2A taken on the line 2B—2B.

In order to establish the operability of lamps according to the invention, 400 W metal halide lamps were made by the above-described method with an offset press seal as shown in FIG. 5 and compared with "Prior Art" lamps having an arc tube with vertical press seals and asymmetric end chambers as shown in FIG. 1. The quartz glass tubing of the lamps according to the invention had a circular cross-section with an inside diameter of 14 mm, the distance between the electrode tips was 43 mm, the insertion depth of the electrode tips from the rear of the end chambers was 7 mm, and the offset distance 'z' from the axis of the cylinder was 4 mm. The radius R1 was 4.7 mm. The arc tubes had a filling of argon at a cold fill pressure of 35 Torr and were dosed with 17 mg Hg, 3.9 mg $HgI_2$, 16.1 mg NaI and 1 mg Sc. The prior art lamps with asymmetric press seals had a circular cross-section with an inside diameter of 14 mm, the distance between the electrode tips was 43 mm, the insertion depth of the electrode tips from the rear of the end chambers was 7 mm, and the offset distance 'z' from the axis of the cylinder was 2.5 mm. The arc tubes had a filling of argon at a cold fill pressure of 35 Torr and were dosed with 15 mg Hg, 3.9 mg $HgI_2$, 16.1 mg NaI, and 1 mg Sc.

The photometric quantities at 1000 hours are shown in Table 1 for both groups of lamps, each group having 6 lamps. The standard deviation for each measurement is shown in parenthesis.

TABLE 1

| | Offset Press | Asymm. Press |
|---|---|---|
| Lamp Voltage (V) | 146.5 (6.8) | 137.5 (11.7) |
| Lumens | 32070 (1130) | 30894 (2180) |
| Efficacy (LPW) | 80.2 (2.79) | 77.3 (5.5) |
| CCT (K) | 4721 (146) | 5091 (469) |
| CRI | 73.2 (1.5) | 73.4 (2.6) |

While the average photometric parameters were generally comparable between the two groups of lamps, it can be seen that the standard deviation of these parameters were significantly less for the lamps according to the invention having an offset press than the standard deviations for the prior art lamps having an asymmetric press. For example, the standard deviations for the luminous efficacy, correlated color temperature (CCT), and color rendering index (CRI were 49%, 68% and 42% lower, respectively, for the lamps according to the invention.

Figure 7:
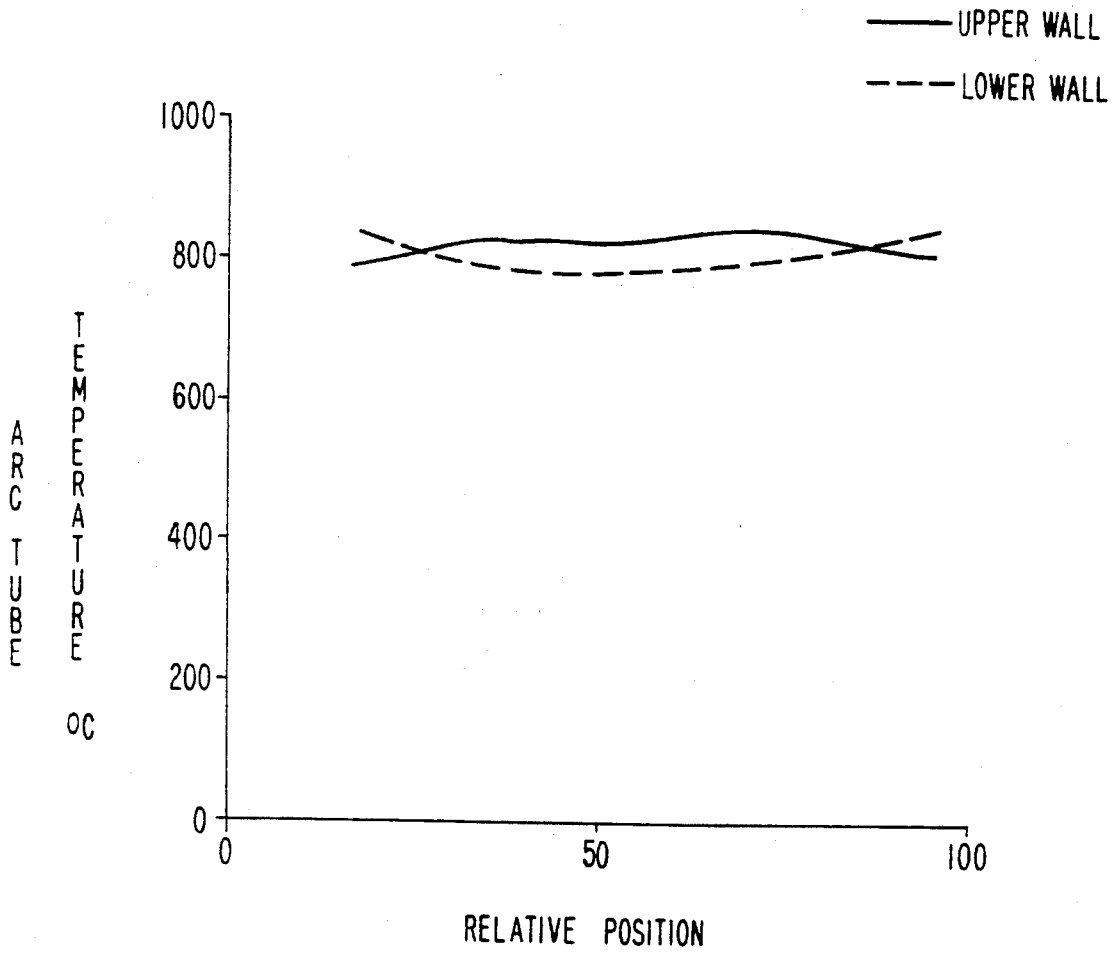
FIG. 7 is a graph illustrating the temperature profile of an arc tube according to FIG. 5.

FIG. 7 shows the temperature profile across the length of the arc tube according to the invention. The maximum temperature difference between the upper and lower walls of the arc tube was about 75° C. and the maximum temperature for the upper wall was approximately 850° C. The low temperature difference contributes favorably to lamp performance while the maximum temperature of about 850° C. does not inhibit lamp life.

While there have been shown what are presently considered to be the preferred embodiments of the invention, it will be apparent to those of ordinary skill in the art that various changes and modifications can be made without departing from the scope of the invention as defined by the appended claims. For example, while a circular cylindrical tube is preferred, it is readily apparent that tubes of other cross-sections, such as oval, or even non-cylindrical tubes may be used in the method according to the invention.

What is claimed is:

1. A method of manufacturing a high pressure discharge lamp arc tube having press seals at each end thereof and end chambers into which respective discharge electrodes extend, said method including the steps of providing a length of tubing of vitreous material having a longitudinal tube axis, providing a conductive lead-through connected to a discharge electrode, positioning said lead-through and discharge electrode with respect to an end portion of said tube, softening said end portion by heating, and pressing said end portion with opposing press jaws to form a generally planar press seal about said lead-through, wherein the improvement comprises:

positioning said press seal, said lead-through, and said discharge electrode offset from said longitudinal tube axis in a direction normal to said press seal.

2. A method according to claim 1, wherein said press seal is formed offset from said longitudinal tube axis by positioning said lead-through and discharge electrode offset from said tube axis, and positioning and moving said opposing press jaws to press said heat softened end portion of said tube about said lead-through at said offset position of said lead-through.

3. A method according to claim 2, further comprising providing said press jaws with respective opposing mold portions, and applying a gas pressure within said tube for blowing the softened tube end portion against said mold portions for forming an end chamber adjacent said press seal into which said discharge electrode extends.

4. A method according to claim 3, wherein said press jaws are provided with opposing substantially planar faces, and said mold portions are symmetric about a plane through said tube axis and normal to said faces.

5. A method according to claim 4, wherein said lead-through and said discharge electrode are positioned within said end portion of said tube such that they are aligned with a plane through said tube axis and normal to said faces in the closed position of said press jaws.

6. A method according to claim 4, wherein said discharge electrode is angled with respect to said lead-through, and said lead-through is additionally positioned in said end portion of said tube laterally offset from the tube axis such that upon closing of said press jaws said discharge electrode is coplanar with said press seal and the tip of said electrode is aligned with a plane normal to said press seal and through said tube axis.

7. A method according to claim 6, further comprising providing a starting electrode connected to an other lead-through and positioning said other lead-through in said tube end portion laterally on the opposite side of said tube axis.

8. A method according to claim 7, wherein another press seal is formed at the opposite end of said tube offset from said tube axis such that both press seals are coplanar and said end chambers are symmetric to each other.

9. A method according to claim 8, wherein said tube provided is a right circular cylinder.

10. A method according to claim 7, wherein said tube provided is a right circular cylinder.

11. A method according to claim 6, wherein another said press seal is formed at the opposite end of said tube offset from said tube axis such that both press seals are coplanar and said end chambers are symmetric to each other.

12. A method according to claim 6, wherein said tube provided is a right circular cylinder.

13. A method according to claim 5, wherein another said press seal is formed at the opposite end of said tube offset from said tube axis such that both press seals are coplanar and said end chambers are symmetric to each other.

14. A method according to claim 5, wherein said tube provided is a right circular cylinder.

15. A method according to claim 4, wherein another said press seal is formed at the opposite end of said tube offset from said tube axis such that both press seals are coplanar and said end chambers are symmetric to each other.

16. A method according to claim 4, wherein said tube provided is a right circular cylinder.

17. A method according to claim 3, wherein another press seal is formed at the opposite end of said tube offset from said tube axis such that both press seals are coplanar and said end chambers are symmetric to each other.

18. A method according to claim 3, wherein said tube provided is a right circular cylinder.

19. A method according to claim 2, wherein another press seal is formed at the opposite end of said tube offset from said tube axis such that both press seals are coplanar and said end chambers are symmetric to each other.

20. A method according to claim 2, wherein said tube provided is a right circular cylinder.

* * * * *